US010823168B2

(12) United States Patent
Barron

(10) Patent No.: US 10,823,168 B2
(45) **Date of Patent: *Nov. 3, 2020**

(54) ROTARY PISTON PUMP MADE OF PLASTIC

(71) Applicant: Robert Bosch GmbH, Stuttgart (DE)

(72) Inventor: Dan Barron, Schaffhausen (CH)

(73) Assignee: ROBERT BOSCH GMBH, Stuttgart (DE)

( * ) Notice: Subject to any disclaimer, the term of this patent is extended or adjusted under 35 U.S.C. 154(b) by 950 days.

This patent is subject to a terminal disclaimer.

(21) Appl. No.: 15/027,991

(22) PCT Filed: Sep. 25, 2014

(86) PCT No.: PCT/EP2014/070445
§ 371 (c)(1),
(2) Date: Apr. 7, 2016

(87) PCT Pub. No.: WO2015/052004
PCT Pub. Date: Apr. 16, 2015

(65) Prior Publication Data

US 2016/0245281 A1 Aug. 25, 2016

(30) Foreign Application Priority Data

Oct. 8, 2013 (DE) ..... 10 2013 220 242

(51) Int. Cl.
*F04C 2/08* (2006.01)
*F04B 13/02* (2006.01)
(Continued)

(52) U.S. Cl.
CPC ..... *F04C 2/084* (2013.01); *F04B 13/02* (2013.01); *F04C 2/126* (2013.01); *F04C 15/0003* (2013.01); *F04C 2240/20* (2013.01)

(58) Field of Classification Search
CPC ..... F04B 13/02; F04C 15/0003; F04C 2/084; F04C 2/126
(Continued)

(56) References Cited

U.S. PATENT DOCUMENTS 3,054,417 A 9/1962 Corvisier
4,090,262 A 5/1978 Schneider et al.
(Continued)

FOREIGN PATENT DOCUMENTS

CN 104246219 A 12/2014
EP 1892417 2/2008
WO 9524556 9/1995

OTHER PUBLICATIONS

International Search Report for Application No. PCT/EP2014/070445 dated Nov. 3, 2014 (English Translation, 2 pages).

*Primary Examiner* — Thai Ba Trieu
*Assistant Examiner* — Dapinder Singh
(74) *Attorney, Agent, or Firm* — Michael Best & Friedrich LLP

(57) ABSTRACT

The invention relates to a rotary piston pump for one-time use made of plastic for screwing onto a fastening nozzle on a tubular bag, having two rotors (10), which are coupled to each other via gear wheels (11) and which can be driven in opposition and which are mounted in a pump housing (5), which has suction nozzles (6) and outlet nozzles (7), wherein each rotor (10) has a rotor shaft (12), the rotor shaft ends (15) thereof being mounted in the walls (8, 4) of the pump housing (5), and the gear wheels are integrally molded to the rotor shafts, and wherein each rotor (10) has two rotor wing walls (13) arranged diametrically on the rotor shaft (12) which flare continuously outward and to each of the peripheral ends of which a partially cylindrical rotor wing shoe (14) is molded, wherein the rotor wing shoes (14) contact the cylindrical inside wall regions of the pump housing (5), on
(Continued)

one side, and the rotor wing shafts (13) of the adjacent rotor (10) on the other, in a sliding and sealing matter, wherein seals are integrally molded on the rotor, wherein the seals serve to prevent the effects of air admission onto the content located in the tubular bag to as great an extent as possible.

17 Claims, 3 Drawing Sheets

(51) Int. Cl.
*F04C 2/12* (2006.01)
*F04C 15/00* (2006.01)
(58) Field of Classification Search
USPC ..... 418/206.6
See application file for complete search history.

(56) References Cited

U.S. PATENT DOCUMENTS

| | | | | |
|---|---|---|---|---|
| 4,747,762 | A * | 5/1988 | Fairbairn | F01C 21/18 418/152 |
| 5,180,299 | A | 1/1993 | Feuling | |
| 2008/0038138 | A1 * | 2/2008 | Bishop | F04C 2/126 418/206.2 |

* cited by examiner

ROTARY PISTON PUMP MADE OF PLASTIC

BACKGROUND OF THE INVENTION

The invention relates to a rotary piston pump or, respectively, metering pump made of plastic, having two rotors, which are coupled to each other via gear wheels and which can be driven in opposition and which are mounted in a pump housing, which has suction nozzles and outlet nozzles, wherein each rotor has a rotor shaft, the rotor shaft ends thereof being mounted in the walls of the pump housing.

Metering pumps are known in all sizes and construction types. Particularly manually operated piston pumps are known as metering pumps made of plastic, as said piston pumps are known on soap dispensers for liquid soap or, which is of particular interest here, in the catering and restaurant industry, where, for example, mustard, ketchup or even coffee creamer are dispensed in small doses in fast-food restaurants. Despite these metering pumps, the dispensed quantity varies however relatively dramatically because, in the case of metering pumps and particularly those just described here, the stroke distance should actually be completely used for each operation. This is, however, usually not the case. Instead, one, two or three short strokes are often carried out, and the quantity accordingly varies considerably. As long as this quantity is only dispensed as a side to a hamburger, this is of little significance; however, in those places where such metering pumps are also used to add a special quantity of a liquid food to a recipe, the taste varies as a result of an incorrect pump operation, which is not always appreciated by customers.

Different kinds of pumps are, of course, well known, in particular rotor pumps, which are, however, usually designed as high-precision metering pumps which are manufactured from metal. These pumps are also required in the food industry where large quantities have to be dispensed in doses. In the case of the commercial application, very inexpensive disposable metering pumps are, however, usually provided free of charge. Such metering pumps have to thus be made of plastic, have a design that is as simple as possible and operate reliably.

The metering pump made of plastic which is of interest here is particularly to be conceived for food items which are dispensed in so-called tubular bags or in other soft packagings made of plastic film.

Many liquid foods also contain a higher solids content. Typical examples for such liquid foods are tartar sauce, mustard sauces with pickles, vanilla sauce with chocolate or almond slivers, etc. Such solid-liquid foodstuffs cannot be dispensed in doses with the metering pumps that are common today. This particularly applies to the gear type pumps such as, for example, the one depicted in the French patent publication FR-2313971. In the case of larger solid particles, such as, for example, almond slivers, said particles are ground up by the rotors or block the rotors. As a result, metering pumps, in which the rotors have two or multi-winged rolling elements, accordingly come into consideration for such applications. Examples of such pumps are known from the American patent publication U.S. Pat. No. 3,054,417, where a metering pump for liquid mediums is shown for admixing additional liquids, wherein each rotor has three blade arms and said blade arms roll off on each other and thus transport the medium further. In such pumps, there is sufficient space between the housing and the individual rotor blades in order to also transport liquids containing solid material parts. In this case, the larger solid material parts are less of a problem than in fact the smaller solid material parts which remain stuck on the rotor blades that mutually roll off on each other and are completely crushed during the rolling process, after which deposits may form which reduces the flow rate and can even lead to clogging.

The same also applies to a metering pump according to the WIPO patent publication WO 95/24556, in which only two-bladed rotors are described, which, however, likewise mutually roll off on each other as well as on the housing wall.

A further rotary piston pump is known from the European patent publication EP-1 892 417. This is however conceived as an insert for an outer metallic housing, is however created for disposable use and has a housing made of plastic. The gear train with which the correct relative position of the two rotors is ensured, is a component of a gear unit disposed outside of the actual pump and is not a component of the parts provided for the disposable use. The rotors which mesh with one another during operation have partially cylindrical rotor wing shoes and concave indentations, which are not formed in a manner such that the rotary piston pump is particularly suited for products having solid contents. Particularly the comparatively narrow radii of the concave indentations allow deposits to develop precisely in these regions, which deposits remain in the pump and in the case of foodstuffs possibly spoil rapidly as a result of contact with the outside air. Sealing components in the form of lip seals for the rotor shafts are available as elements which can be separately inserted. Due to the design of this rotary piston pump as an insertable part in a dimensionally stable metal housing and due to the drive shafts that penetrate the rotors and are simultaneously used to hold the housing parts together in a sealing manner, the sealing measures are then focused here also specifically on this region.

SUMMARY OF THE INVENTION

It is therefore the aim of the present invention to provide an improved metering pump, which has a relatively large conveying capacity and is particularly suited to conveying solid-liquid mixtures without having the disadvantages described above. In particular, the air admission onto the content located in the tubular bag is to be reduced to as great an extent as possible, so that said content does not prematurely spoil.

The aim is substantially met by virtue of the fact that a number of seals are integrally molded, respectively molded as one piece, on the respective rotor in the case of a class-specific rotary piston pump comprising two identical rotors.

The number of seals integrally molded on the respective rotor preferably comprises at least lateral sealing lips on the rotor wing walls, sealing-or scraping edges on the exterior surfaces of the rotor wing shoes and longitudinal skimming ribs on the rotor shafts.

The integral arrangement of seals on the respective rotor has the advantage that the rotary piston pumps for one-time use made of plastic are very cost-effective and can be manufactured from very few individual parts.

In a particularly preferred embodiment of the invention, each rotor wing shoe has at least one sealing-or scraping edge which extends parallel to the rotor axis on the outside of the partially cylindrical wall. Such a sealing-or scraping edge can be disposed in close proximity to the front (as seen in the direction of rotation) edge of the respective partially cylindrical wall of the rotor wing shoe. Said sealing-or scraping edge can however, as is shown in the subsequently described exemplary embodiment, also be centrally disposed. Sealing-or scraping edges ensure that no deposits can form on the housing wall.

Further advantageous embodiments of the subject matter of the invention result from the dependent claims and the importance and mode of operation thereof are described in the following description with reference to the attached drawings.

BRIEF DESCRIPTION OF THE DRAWINGS

A preferred exemplary embodiment of the subject matter of the invention is depicted in the drawings. In the drawings:

FIG. 3 again shows the metering pump in a side view, again while omitting the detachable pump housing wall; whereas

DETAILED DESCRIPTION

Figure 1:
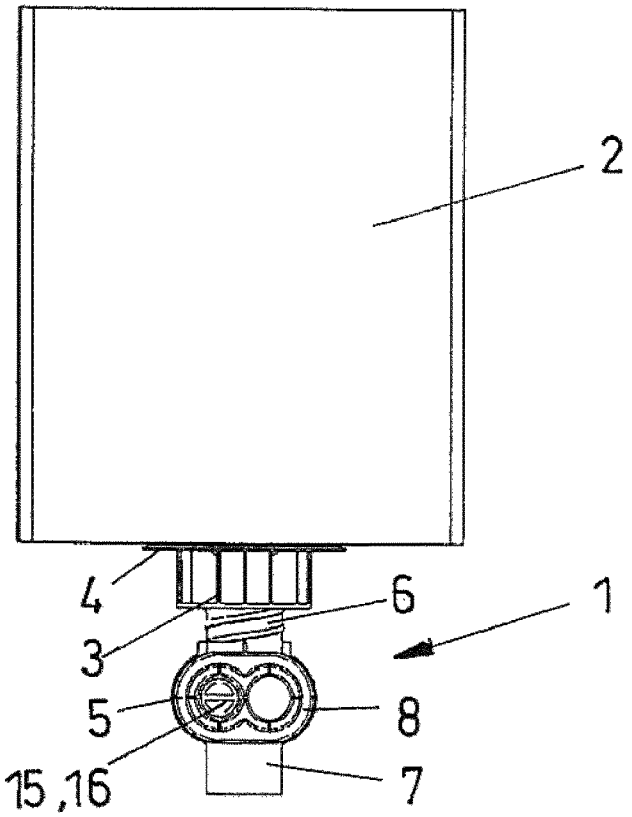
FIG. 1 shows a preferred use of the metering pump according to the invention which is mounted on a tubular bag.

In FIG. 1, a preferred use of the metering pump according to the invention is symbolically depicted on a tubular bag 2, said metering pump being denoted in its entirety with the reference numeral 1. The metering pump 1 is held to the tubular bag 2 by means of a fastening nozzle 3 which is provided with a flange 4. The flange 4 is connected to the tubular bag 2 preferably by means of ultrasonic welding.

The metering pump itself comprises a pump housing 5, which has a suction nozzle 6 and an outlet nozzle 7. The suction nozzle 6 is connected to the fastening nozzle 3 by means of screws. The metering pump itself is shown here with a view to a fixed end wall 8 of the pump housing 5, wherein a rotor shaft end 15 provided with a drive coupling part 16 protrudes through the aforementioned fixed end wall 8 and the drive coupling part 16 can be recognized. The drive coupling part 16 is used to be connected to a drive means, which is not depicted here, in a positive-locking manner.

Figure 2:
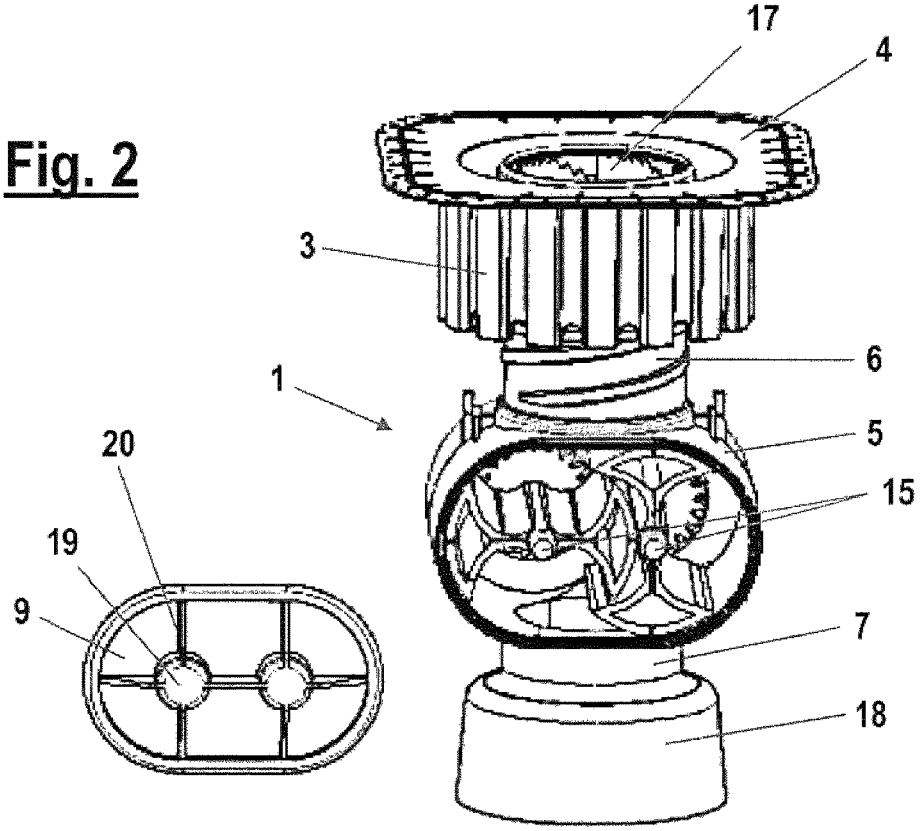
FIG. 2 shows a perspective view of the metering pump with the fastening nozzle, wherein the detachable pump housing wall has been removed.

In FIG. 2, the metering pump 1 with the fastening nozzle is depicted in isolation. In this perspective view, the view is at an angle from above onto the aforementioned flange 4 and opening means 17 are seen, which are designed here as perforating and cutting teeth and lie in this position prior to the initial use still completely within the suction nozzle 6. Prior to the initial use, the pump housing 5 comprising the suction nozzle 6 thereof is screwed into the fastening nozzle 3 up to a stop, wherein the aforementioned opening means 17 cut open an aseptically sealed receptacle, preferably a tubular bag made of plastic film. In the transport position of the metering pump 1 that is depicted here, the outlet nozzle 7 is additionally provided with a cover lid 18 which ensures that no foreign matter or foreign particles can enter into the metering pump during transport and storage.

In FIG. 2, the pump housing 5 is shown open. Whereas in FIG. 1, as previously mentioned, the view is onto the fixed end wall 8 of the pump housing 5, the metering pump 1 is shown here rotated about an angle of 180° and the view is onto that side of the metering pump 1 comprising a detachable end wall 9. This detachable end wall 9 is shown laterally offset or, respectively, detached. Said detachable end wall 9 can also be denoted as the pump housing cover. In this figure, the view is onto the outside of the pump housing cover, and sealed bearing bushings 19 can be seen which project outwards and are capable of accommodating the rotor shaft ends 15 on the inside. The bearing bushings 19, which are closed to the outside, are held stably with reinforcement ribs on the outside of the detachable end wall 9.

Figure 3:
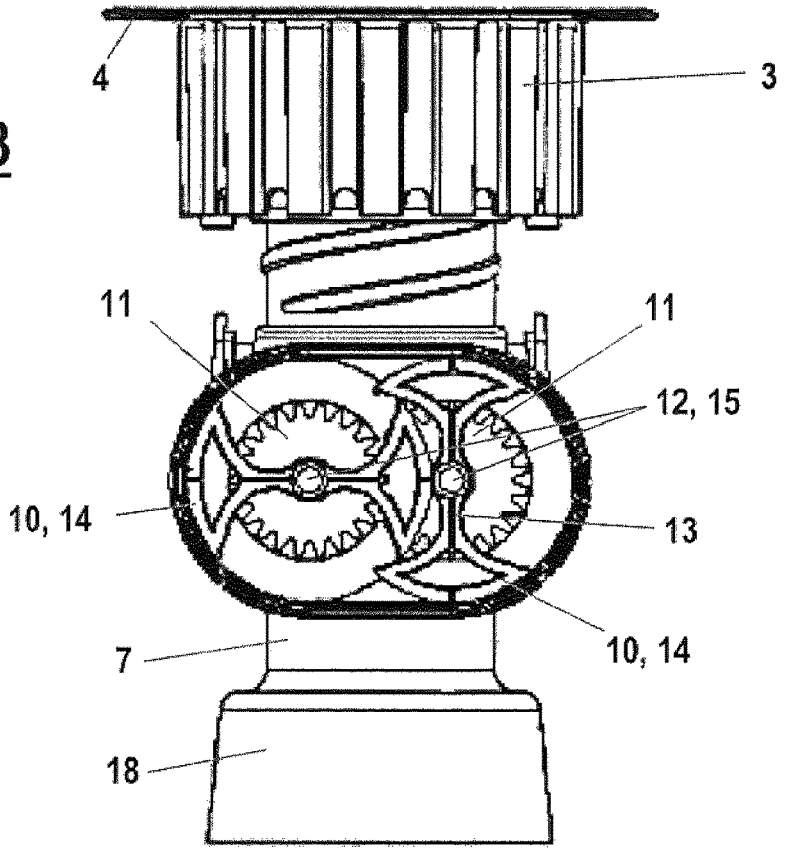

In FIG. 3, the metering pump 1 is shown in the lateral position, however in the same usage position as in FIG. 2 and with the omission of the detachable end wall of the pump housing 5. In this view, the two rotors 10 mounted in the pump housing 5 are clearly seen. Gear wheels 11 are preferably integrally molded to said rotors and cause the two rotors to move in opposite directions if one of the two rotors is driven. Reference is made to the following FIG. 4 with regard to the design of the two rotors 10. In FIG. 3, it can be seen that each rotor is provided with a rotor shaft 12, wherein the view here is onto the rotor shaft ends 15 and wherein two rotor wing walls 13 diametrically opposed to one another are each integrally molded to the rotor shafts 12. Respectively one rotor wing shoe 14 is molded to the peripheral ends of the rotor wing walls 13. Each rotor wing shoe has a partially cylindrical shape which is adapted in curvature to the cylindrical part of the pump housing 5. As can be seen here, each rotor wing shoe 14 permanently contacts either the inside of the pump housing or the rotor shaft 12 of the adjacent rotor.

Figure 4:
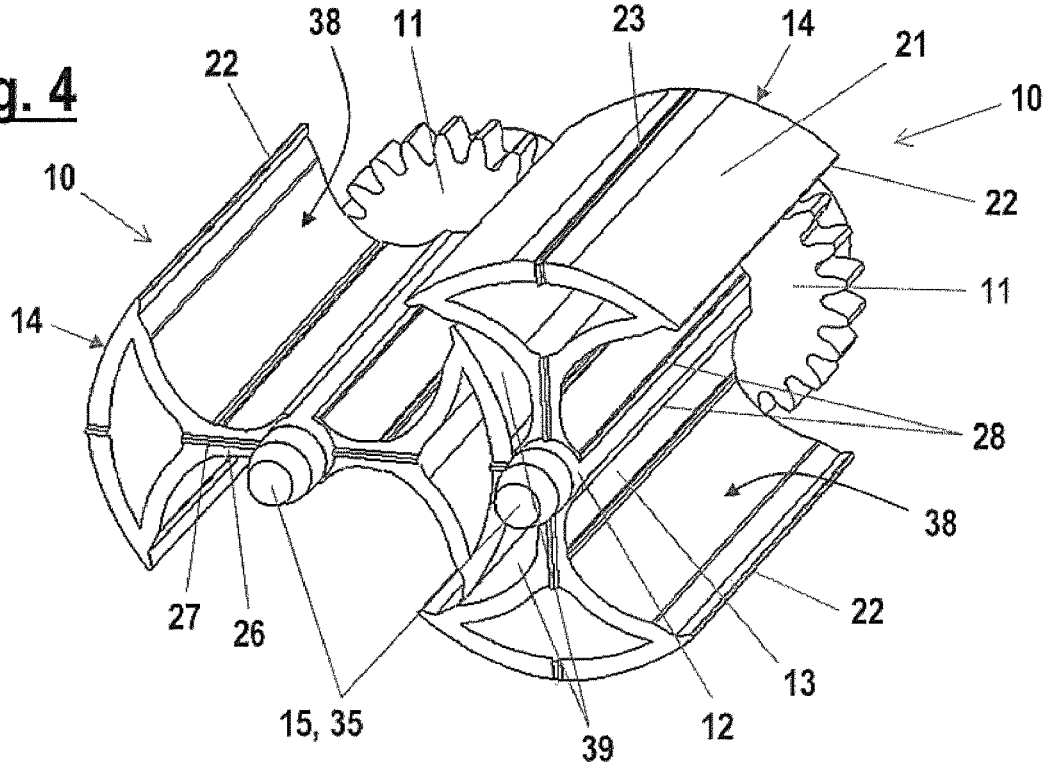
FIG. 4 shows the two rotors in isolation in the correct relative position to one another as depicted in a perspective view.

In FIG. 4, the configuration of the two rotors can now be seen in detail. Said rotors are depicted in isolation and in fact in a correct relative position as intended during installation; however, without the pump housing 5. The parts previously mentioned in connection with FIG. 3, namely the rotor shaft 12 or the corresponding rotor shaft ends 15, are not denoted here again in order to not unnecessarily clutter the figure. The special embodiment of the rotor wing shoes 14 can be seen especially clearly in this figure. The rotor wing shoes 14 are, as previously mentioned, integrally molded to the peripheral ends of the rotor wing walls 13 in such a way that the rotor wing walls 13 substantially flare continuously outward and thus merge into the rotor wing shoes 14. The rotor wing shoes have a partially cylindrical exterior surface 21. The radius of curvature of this exterior surface corresponds to the distance between an axis which extends through the rotor shaft 12 centrally in the longitudinal direction thereof and the exterior surface 21 of the rotor wing shoes. The rotor wing walls 13 which flare continuously outward form concave indentations 38, wherein the shape or, respectively, the curve shape of the concave indentations are selected and optimized in such a manner that as few as possible or no product residues remain in the concave indentations.

The metering pump according to the invention is preferably designed in such a way that the pump seals the connection between suction nozzle 6 and outlet nozzle 7. To this end, the pump respectively the rotors 10 thereof and the pump housing 5 have a plurality of different sealing elements. These sealing elements have, however, also a cleansing effect and prevent deposits in the pump housing, which can lead to a reduction in quality and to leaks as well as to blockages of the pump in the worst case scenario.

The rotor wing shoes 14 have accordingly at least one sealing-or scraping edge 23 on the exterior surface 21. This can, as shown in FIG. 4, be centrally disposed or can, for example, also be disposed in close proximity of an end edge 22 leading in the direction of rotation. This sealing-or scraping edge 23 has substantially the form of a torus which extends parallel to the rotor shaft 12 on the aforementioned exterior surface 21. As the name states, the sealing-or scraping edge 23 is used on the one hand to form a seal between the inner cylindrical wall of the pump housing 5 and the rotor 10, and at the same time said sealing-or scraping edge 23 is also used to prevent the formation of deposits by means of the scraping effect thereof. Each rotor wing shoe 14 can also be furnished with two sealing-or scraping edges 23, namely in close proximity to the leading end edge 22 as well as in close proximity to the trailing end edge 22. Both rotors are preferably designed absolutely identically in order to require only one injection mold. This also has the advantage that no source of error arises during installation if both rotors have the same design.

The sealing-or scraping edge 23 has preferably an approximately triangular shape in cross section. Other shapes are, however, also possible.

In FIG. 4, it can further be seen that the rotor wing walls 13 have end faces 26. A sealing lip 27 is disposed in each case so as to extend centrally from the rotor shaft ends 15 up to the exterior surface 21 of the rotor wing shoes 14 on the end faces 26, which, in the installed state of the rotors in the pump housing 5, come to rest in the direction of the detachable end wall 25 respectively the pump housing cover. On the opposite end face, which is not visible here, the gear wheels are in contact with said end faces in an integrally connected manner. Such sealing lips are mounted on the corresponding end face partial regions so as to extend only from the corresponding gear wheel up to the exterior surface 21 of the rotor wing shoes.

In order that the rotor wing shoes 14 are also sealed off from the rotor shaft 12, longitudinal skimming ribs 28 are also mounted on the rotor shaft 12. These skimming ribs 28 extend parallel to the axis of the rotor shaft. In so doing, it is in principle sufficient to mount respectively one longitudinal skimming rib 28 on each rotor shaft; however, two of such longitudinal skimming ribs are preferably mounted on the same side in each case. Said longitudinal skimming ribs 28 have not only a sealing effect but also clean the rotor wing shoes 14 of deposits which can possibly form on the exterior side 21 thereof. A self-cleaning metering pump is practically formed by means of these design features.

Figure 5:
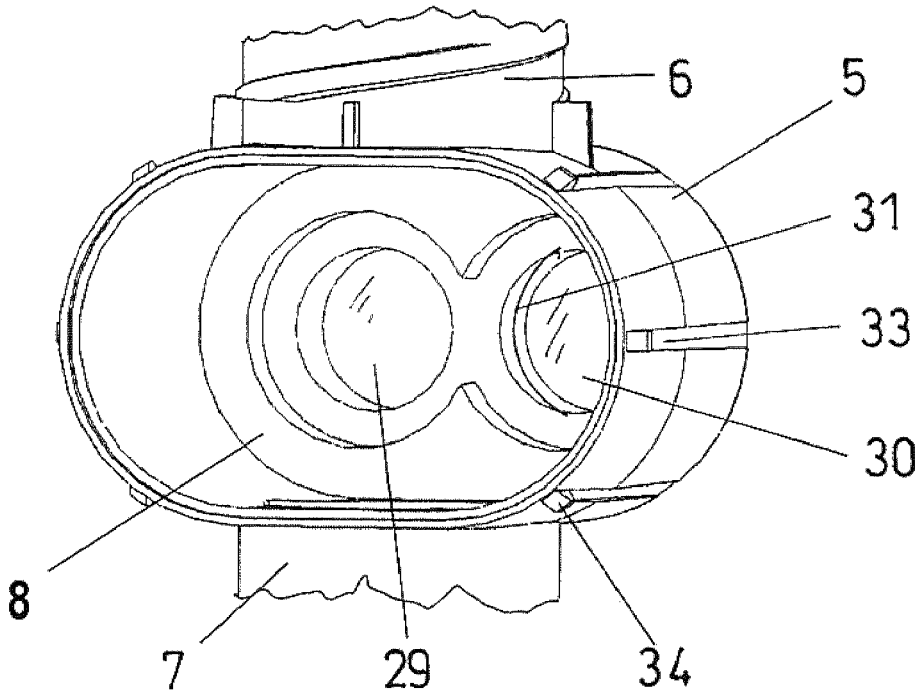
FIG. 5 shows a perspective partial view of the pump housing in isolation.

In FIG. 5, the pump housing 5 is depicted in isolation. The suction nozzle 6 and the outlet nozzle 7 are only visible to some extent. In the case of this solution, the pump housing cover or, respectively, the detachable end wall 9 of the pump housing is again removed. A view is thus cast onto the inner side of the fixed end wall 8 of the pump housing 5. Second bearing sleeves 29, 30 are formed in here, wherein the one second bearing sleeve 29 is designed closed and the other bearing sleeve 30 is continuously open to the outside. A circumferential sealing lip 31 is preferably molded with a reduced height in this open bearing sleeve 30. A plurality of such circumferential sealing lips 31 can, however, also be present and thus practically form a type of labyrinth seal. Other solutions are also alternatively possible, in which one or also a plurality of circumferential sealing lips are not mounted on the bearing sleeve 30 but rather on the rotor shaft end 15 inserted into said bearing sleeve, i.e. on the rotor shaft end comprising the drive coupling part 16.

The rotors 10 therefore have on both sides rotor shaft ends 15, which are designed as rotor shaft journals 35, on the rotor shafts 12 thereof. The rotor shaft journals 35 have a smaller diameter on the side of the pump housing cover 9, whereas the rotor shaft ends have a substantially larger diameter on the other side. Because, as previously mentioned, the two rotors are preferably identically designed, both rotors also have a so-called drive coupling part 16, which was already described with regard to FIG. 1, at each rotor shaft end with the larger diameter. Whereas the open bearing sleeve 30 is disposed on the left in FIG. 1 and the drive coupling part 16 can thus be seen there, the closed bearing sleeve 29 is depicted on the right in FIG. 1. In FIG. 5, in which the pump housing is now viewed from the inside, the closed second bearing sleeve 29 can consequently be seen on the left and the second open bearing sleeve 30 on the right. The corresponding circumferential sealing lip 31 is installed only in the second open bearing bushing 30.

Figure 6:
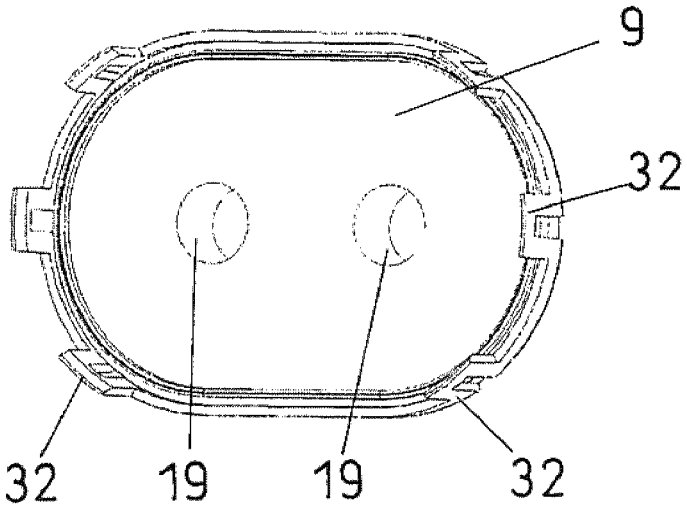
FIG. 6 shows the detachable pump housing wall in a perspective view with a view to the inside thereof.

In FIG. 6, the detachable end wall 9 respectively the pump housing cover 9 is now depicted in isolation. FIG. 6 thus reveals a plurality of spring tongues 32 which, in the closed state of the pump housing cover, hook into detent means 33, which have corresponding cams 34, outside on the pump housing 5.

As previously mentioned, bearings are also formed in the detachable end wall 9. These are however denoted here as closed bearing bushings 19. Because these bearing bushings 19 are closed, no additional sealing means are required here. The diameter of said closed bearing bushings 19 is substantially smaller than the diameter of the two bearing sleeves 29 and 30. The rotor shaft ends 15 engage into said closed bearing bushings 19, said rotor shaft ends, as previously mentioned, also being designed as rotor shaft journals 35, as this can be seen most clearly in FIG. 4.

The rotary piston pump described here has particularly good sealing properties due to the integral arrangement of the seals on the rotors. A further contributing factor to the good sealing properties results, however, also from the particular shape of the rotors or, respectively, from the curve shape of the concave indentations on the rotors, which are formed in such a way or optimized to the effect that as few as possible or no product residues remain in the concave indentations during a pumping operation.

For the purpose of reducing residues, the rotor wing walls (13), which flare continuously outward and comprise the rotor wing shoes (14), have the aforementioned concave indentations (38) on the peripheral ends thereof, the shape respectively curve shape of which is formed or optimized in such a way that a quasi-permanent, mutual contact of the end edges (22) with the surface of the concave indentations (38) takes place and, as a result, as few as possible or no product residues remain in the concave indentations during a pumping operation. Any possible product residues in the concave indentations are continuously removed from the end edges (22) of the rotor wing shoes. The term quasi-permanent is used here in a sense which should clarify that the described state is in fact not permanent but occurs time and again on a regular and repeated basis.

In connection with the previously described features for reducing residues in the concave indentations, it can also namely be determined that partial chambers are formed in a quasi-permanent manner in the intermediate region between the two rotors during operation. These regularly recurring but not permanently present partial chambers form for the following reasons:

a) on the one hand due to the feature that the exterior surface (21) of each rotor wing shoe (14) of a rotor contacts the rotor shaft (12) of the adjacent rotor (10) during operation. In this way, a first partial chamber sealing results.

b) on the other hand due to the property that a quasi-permanent, mutual contact of the end edges (22) with the surface of the concave indentations (38) also takes place, at least approximately a second partial chamber sealing thus results.

The partitioning effect of these partial chambers also, of course, at least partially achieves that the effects of the air admission on the content located in the tubular bag are reduced.

Fluids as well as mixtures of fluids and solids can be conveyed without problems with the metering pump 1 described here. The size of the solid particles practically does not play a role here. Said solid particles have to, of course, be of a size which is smaller than the distance between the two rotor shafts. It is not a factor whether the solid particles are coarse-grained or fine-grained and thus more or less strongly tend to form deposits. On the one hand, the solid particles are not ground up; and, on the other hand, the deposits of said solid materials on the pump housing as well as on the rotor wing shoes or the rotor shafts are continually removed by means of the means described above. It is thereby ensured that the metering pump, which is used as a disposable metering pump, always operates reliably for the required service life. Because a high degree of impermeability additionally exists between the outlet nozzle 7 and the tubular bag 2 thanks to the design described above, a practically aseptic state is maintained in the tubular bag during the entire emptying process. The foodstuff, which is delivered in the completely closed aseptic tubular bag, can accordingly be provided without or at least with substantially fewer preservatives.

LIST OF REFERENCE SIGNS

1 metering pump
2 tubular bag
3 fastening nozzle
4 flange
5 pump housing
6 suction nozzle
7 outlet nozzle
8 fixed end wall of the pump housing
9 detachable end wall of the pump housing (pump housing cover)
A axis of the rotor shaft
10 rotor
11 gear wheels
12 rotor shaft
13 rotor wing walls
14 rotor wing shoes
15 rotor shaft ends
16 drive coupling part
17 opening means
18 cover lid
19 closed bearing bushings
20 reinforcement ribs
21 exterior surface of the rotor wing shoes
22 end edge of the rotor wing shoes
23 sealing-or scraping edge
24 not used
25 not used
26 end face
27 sealing lip
28 longitudinal skimming ribs
29 second bearing sleeves closed
30 second bearing sleeves open
31 circumferential sealing lip in open bearing sleeve
32 spring tongues
33 detent means
34 cam
35 rotor shaft journal
36 external thread
37 internal thread
38 concave indentations
39 partial chambers

What is claimed is:

1. A rotary piston pump for one-time use made of plastic for screwing onto a fastening nozzle on a tubular bag, the rotary piston pump comprising two rotors (10) which are coupled to each other via gear wheels (11) and which can be driven in opposition and which are mounted in a pump housing (5), which has a suction nozzle (6) and an outlet nozzle (7), wherein each rotor (10) has a rotor shaft (12) rotatable about a respective rotor axis, rotor shaft ends (15) of the rotor shaft (12) being mounted in walls (8, 4) of the pump housing (5), and each of the gear wheels (11) is integrally molded to a respective one of the rotor shafts (12), and wherein each rotor (10) has two rotor wing walls (13) which are arranged diametrically on the rotor shaft (12), which are generally perpendicular to the rotor axis, which flare continuously outward and to each of peripheral ends of which a rotor wing shoe (14) is molded, wherein the rotor wing shoe (14) forms a portion of a cylinder centered on the rotor axis, and wherein each of the rotor wing shoes (14) contacts a respective cylindrical inside wall region of the pump housing (5), on one side, and the rotor shaft (12) of the adjacent rotor (10) on the other, in a sliding and sealing manner, characterized in that seals are integrally molded on each of the rotors (10), wherein the seals substantially prevent effects of air admission onto content located in the tubular bag, wherein the seals comprise, on each of the rotor wing walls (13), a lateral sealing lip (27) extending radially outward from the respective rotor axis.

2. The rotary piston pump according to claim 1, characterized in that the seals comprise sealing or scraping edges (23) on exterior surfaces (21) of the rotor wing shoes (14).

3. The rotary piston pump according to claim 2, characterized in that the pump housing (5) has a closed bearing sleeve (29) for accommodating a first rotor shaft journal (35) as well as an open bearing sleeve (30) for accommodating a second rotor shaft journal (35) comprising a drive coupling part (16), wherein further sealing means are present in a region of the open bearing sleeve (30).

4. The rotary piston pump according to claim 3, characterized in that the further sealing means comprise at least one circumferential sealing lip (31') which is integrally molded on the second rotor shaft journal (35) which is configured to be inserted into the open bearing sleeve (30) of the pump housing (5).

5. The rotary piston pump according to claim 4, characterized in that the further sealing means comprise at least one circumferential sealing lip (31) which is integrally molded on the open bearing sleeve (30).

6. The rotary piston pump according to claim 5, characterized in that the rotor wing walls (13), which comprise the rotor wing shoes (14) and flare continuously outward, have concave indentations (38) on the peripheral ends thereof, the shape or, respectively, the curve shape of said indentations is formed in such a way that a quasi-permanent, mutual contact of the end edges (22) with the surface of said concave indentations (38) results and therefore as few as possible or no product residues remain in said concave indentations during a pumping operation.

7. The rotary piston pump according to claim 6, characterized in that partial chambers (39) can be formed in the intermediate region between the two rotors (10) in a quasi-permanent manner during operation, wherein on the one hand, due to the feature that the exterior surface (21) of each rotor wing shoe (14) of a rotor contacts the rotor shaft (12) of the adjacent rotor (10) during operation, a first partial chamber-sealing is achieved, and on the other hand, due to the feature that a quasi-permanent, mutual contact of the end edges (22) with the surface of the concave indentations (38) results during operation, at least approximately a second partial chamber-sealing is achieved, whereby the effects of air admission onto the content located in the tubular bag are likewise reduced as a result of partitioning.

8. The rotary piston pump according to claim 2, wherein the sealing or scraping edges are centered between and parallel to end edges (22) of the rotor wing shoes and extend radially from the exterior surfaces (21) of the rotor wing shoes (14), wherein the end edges are parallel to the rotor axis.

9. The rotary piston pump according to claim 1, characterized in that the pump housing (5) has a closed bearing sleeve (29) for accommodating a first rotor shaft journal (35) as well as an open bearing sleeve (30) for accommodating a second rotor shaft journal (35) comprising a drive coupling part (16), wherein further sealing means are present in a region of the open bearing sleeve (30).

10. The rotary piston pump according to claim 9, characterized in that the further sealing means comprise at least one circumferential sealing lip (31') which is integrally molded on the second rotor shaft journal (35) which is configured to be inserted into the open bearing sleeve (30) of the pump housing (5).

11. The rotary piston pump according to claim 10, characterized in that the further sealing means comprise at least one circumferential sealing lip (31) which is integrally molded on the open bearing sleeve (30).

12. The rotary piston pump according to claim 1, characterized in that the rotor wing walls (13), which comprise the rotor wing shoes (14) and flare continuously outward, have concave indentations (38) on the peripheral ends thereof, a shape or, respectively, a curve shape of said indentations is formed in such a way that a quasi-permanent, mutual contact of end edges (22) with a surface of said concave indentations (38) results and therefore as few as possible or no product residues remain in said concave indentations during a pumping operation.

13. The rotary piston pump according to claim 12, characterized in that partial chambers (39) can be formed in the intermediate region between the two rotors (10) in a quasi-permanent manner during operation, wherein on the one hand, because an exterior surface (21) of each rotor wing shoe (14) of one of the two rotors contacts the rotor shaft (12) of the other of the two rotors (10) during operation, a first partial chamber-sealing is achieved, and on the other hand, due to the feature that a quasi-permanent, mutual contact of the end edges (22) with the surface of the concave indentations (38) results during operation, at least approximately a second partial chamber-sealing is achieved, whereby the effects of air admission onto the content located in the tubular bag are likewise reduced as a result of partitioning.

14. The rotary piston pump according to claim 13, characterized in that the seals comprise longitudinal skimming ribs (28) on the rotor shafts (12).

15. A rotary piston pump for one-time use made of plastic for screwing onto a fastening nozzle on a tubular bag, the rotary piston pump comprising two rotors (10) which are coupled to each other via gear wheels (11) and which can be driven in opposition and which are mounted in a pump housing (5), which has a suction nozzle (6) and an outlet nozzle (7), wherein each rotor (10) has a rotor shaft (12) rotatable about a respective rotor axis, rotor shaft ends (15) of the rotor shaft being mounted in walls (8, 4) of the pump housing (5), and each of the gear wheels is integrally molded to a respective one of the rotor shafts, and wherein each rotor (10) has two rotor wing walls (13) which are arranged diametrically on the rotor shaft (12), which are generally perpendicular to the rotor axis, which flare continuously outward and to each of peripheral ends of which a rotor wing shoe (14) is molded, and wherein each rotor wing shoe has an exterior surface (21) that forms a portion of a cylinder centered on the respective rotor axis, and wherein each rotor wing shoes (14) contacts a respective cylindrical inside wall regions of the pump housing (5), on one side, and the rotor shaft (12) of the adjacent rotor (10) on the other, in a sliding and sealing manner, characterized in that seals are integrally molded on each of the rotors, wherein the seals substantially prevent effects of air admission onto content located in the tubular bag, wherein the seals comprise, on the exterior surfaces (21) of the rotor wing shoes (14), sealing or scraping edges (23) in contact with the respective cylindrical inside wall regions of the pump housing.

16. The rotary piston pump according to claim 15, wherein the sealing or scraping edges are centered between and parallel to end edges (22) of the rotor wing shoes and extend radially from the exterior surfaces (21) of the rotor wing shoes (14), wherein the end edges are parallel to the rotor axis.

17. A rotary piston pump for one-time use made of plastic for screwing onto a fastening nozzle on a tubular bag, the rotary piston pump comprising two rotors (10) which are coupled to each other via gear wheels (11) and which can be driven in opposition and which are mounted in a pump housing (5), which has a suction nozzle (6) and an outlet nozzle (7), wherein each rotor (10) has a rotor shaft (12) rotatable about a respective rotor axis, rotor shaft ends (15) of the rotor shaft being mounted in walls (8, 4) of the pump housing (5), and each of the gear wheels is integrally molded to a respective one of the rotor shafts, and wherein each rotor (10) has two rotor wing walls (13) which are arranged diametrically on the rotor shaft (12), which are generally perpendicular to the rotor axis, which flare continuously outward and to each of peripheral ends of which a rotor wing shoe (14) is molded, and wherein each rotor wing shoe has an exterior surface (21) that forms a portion of a cylinder centered on the respective rotor axis, and wherein each rotor wing shoes (14) contacts a respective cylindrical inside wall regions of the pump housing (5), on one side, and the rotor shaft (12) of the adjacent rotor (10) on the other, in a sliding and sealing manner, characterized in that seals are integrally molded on each of the rotors, wherein the seals substantially prevent effects of air admission onto content located in the tubular bag, wherein the seals comprise, on each of the rotor shafts (12), longitudinal skimming ribs (28) that extend parallel to the respective rotor axis and that are configured to clean the exterior surfaces of the rotor wing shoes on the adjacent rotor.

* * * * *